US008213839B2

(12) United States Patent
Cavill et al.

(10) Patent No.: US 8,213,839 B2
(45) Date of Patent: Jul. 3, 2012

(54) REDUCING TONER LEAKS USING INTERNAL SUPPORT

(75) Inventors: Gregory Alan Cavill, Winchester, KY (US); James Richard Leemhuis, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 857 days.

(21) Appl. No.: 12/252,587

(22) Filed: Oct. 16, 2008

(65) Prior Publication Data

US 2010/0098461 A1 Apr. 22, 2010

(51) Int. Cl.
*G03G 15/08* (2006.01)

(52) U.S. Cl. ..... 399/262

(58) Field of Classification Search ..... 399/262, 399/119, 263, 254, 256
See application file for complete search history.

(56) References Cited

U.S. PATENT DOCUMENTS

| | | | | |
|---|---|---|---|---|
| 4,075,977 | A * | 2/1978 | Williams | 399/254 |
| 4,783,678 | A * | 11/1988 | Honda et al. | |
| 5,752,134 | A * | 5/1998 | Hazama et al. | |
| 6,971,205 | B2 * | 12/2005 | Woodruff | |
| 6,987,942 | B2 * | 1/2006 | Yoshikawa et al. | 399/262 |
| 2007/0177904 | A1 * | 8/2007 | Arai | 399/262 |
| 2010/0232815 | A1 * | 9/2010 | Zheng | 399/254 |

FOREIGN PATENT DOCUMENTS

JP 61198258 A * 9/1986

* cited by examiner

*Primary Examiner* — Susan Lee
(74) *Attorney, Agent, or Firm* — John Victor Pezdek

(57) ABSTRACT

To prevent the developer housing of a toner cartridge from flexing and thereby causing toner leaks, one or more support ribs are added internally to the developer housing, near the developer roll opening to prevent housing flexure. The support rib is designed to not impede toner flow, or movement and installation of components within the cartridge (such as the agitator or other moving parts). The support rib may be formed integrally within the housing, or formed separately and then installed within housing.

20 Claims, 9 Drawing Sheets

REDUCING TONER LEAKS USING INTERNAL SUPPORT

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Invention

The present invention relates generally to toner cartridges, and in particular, to techniques for reducing toner cartridge leaks.

2. Description of the Related Art

In general, toner cartridges are relatively large, and oftentimes contain a large amount of toner (e.g., 1 kg of toner, or more). With such a large plastic vessel and toner load, the cartridge is prone to large amounts of flexure when exposed to shock loading. This flexure allows the release of toner from the cartridge, which causes a number of problems. For instance, the released toner is messy and may come into contact with end users. In addition, such unintended toner release causes a reduction in the printing life of the cartridge due to toner loss, and in some cases renders the cartridge unusable due to housing and part failure.

In addition to such size and toner load considerations, toner cartridges can be designed to print across the full width of a letter sized page or larger. This requires that an opening be made in the toner cartridge to allow a controlled amount of toner to pass out of the cartridge onto the developer roll. Seals are added around the developer roll to control toner from leaking from the cartridge. However, this large opening creates a relatively long unsupported portion in the cartridge structure (over eight inches or longer in many cases). The deflection of this unsupported portion can be considerable, particularly during high shock loading on the toner cartridge, such as the loading incurred when the cartridge is dropped. For instance, toner cartridges have the potential to be dropped and exposed to large shock forces when being shipped separate from the printer.

In short, dropping or otherwise flexing the toner cartridge can lead to excessive toner leaks, or a damaged cartridge being shipped to the customer. Based on drop test results, attempts have been made to stiffen the developer housing by adding external features.

SUMMARY OF THE INVENTION

One embodiment of the present invention provides a toner cartridge including a developer roll for providing toner during an imaging process, and a developer housing operatively coupled to the developer roll and for storing toner. The developer housing is configured with an elongated opening that allows a controlled amount of toner to pass onto the developer roll. A support rib is operatively coupled within the developer housing near the elongated opening, and is for inhibiting flexure of the developer housing. In one particular such embodiment, the support rib is a distance d2 from the developer roll, such that the support rib does not interfere with a toner log recirculating inside the toner cartridge. The toner cartridge may further include a toner adder roll for delivering toner to the developer roll. In one such case, the support rib is a distance d1 from the toner adder roll, so that toner passes between the support rib and the toner adder roll in a substantially unobstructed fashion. The distance d1 can vary, and in some example embodiments is about 1 mm to 10 mm, or more specifically about 3 mm to 5 mm, or even more specifically about 3 mm to 4 mm (e.g., 3.7 mm). The distance d2 may vary as well, and in some embodiments is about 5 mm to 20 mm, or more specifically about 8 mm to 12 mm, or even more specifically about 9 mm to 10 mm (e.g., 9.3 mm). The toner cartridge may include a doctor blade positioned to contact the developer roll and create a nip therebetween. The support rib may be made from, for example, ABS plastic or a hybrid of ABS plastic and other material. In one particular embodiment, the support rib is an integral component of the developer housing. In another particular embodiment, the support rib is secured to the developer housing using a fastening mechanism (e.g., screw or bonding material). In some embodiments, the toner cartridge includes a plurality of support ribs near the elongated opening of the developer housing. In another particular embodiment, the support rib has a shape that prevents both bowing along the opening of the developer housing and rotational deflection of the developer housing. In one such case, the shape includes two opposing and substantially flat sides defining a width w at a bottom portion and a wider top portion, and a thickness t, the sides extending into the developer housing so as to not restrict toner flow. The shape may further include top and bottom edges at the top and bottom portions, respectively, each edge for operatively coupling to an internal wall within the developer housing and near the elongated opening. The width w can vary, and in some embodiments is about 7 mm to 14 mm, or even more specifically about 10 mm to 11 mm (e.g., 10.8 mm).

Another embodiment of the present invention includes a support rib for a toner cartridge. The support rib includes two opposing and substantially flat sides defining a width w at a bottom portion and a wider top portion, and a thickness t. The sides are configured to extend into a developer housing of the toner cartridge so as to not restrict toner flow. The support rib further includes top and bottom edges at the top and bottom portions, respectively. Each edge is for operatively coupling to an internal wall within the developer housing and near an elongated opening of the developer housing that allows a controlled amount of toner to pass onto a developer roll of the toner cartridge. The support rib is for inhibiting flexure of the developer housing, to prevent toner leakage. In some example cases, the width w is about 10 mm to 11 mm and the thickness t is about 2 mm or less. The rib may be integrally formed within the developer housing, or may be installable within the housing.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

BRIEF DESCRIPTION OF THE DRAWINGS

The above-mentioned and other features and advantages of this disclosure, and the manner of attaining them, will become more apparent and the disclosure will be better understood by reference to the following description of embodiments taken in conjunction with the accompanying drawings, wherein.

DETAILED DESCRIPTION

As previously explained, dropping or otherwise flexing a toner cartridge can lead to excessive toner leaks, or a damaged cartridge being shipped to the customer. Based on drop test results, attempts have been made to stiffen the developer housing by adding external features.

Figure 1A:
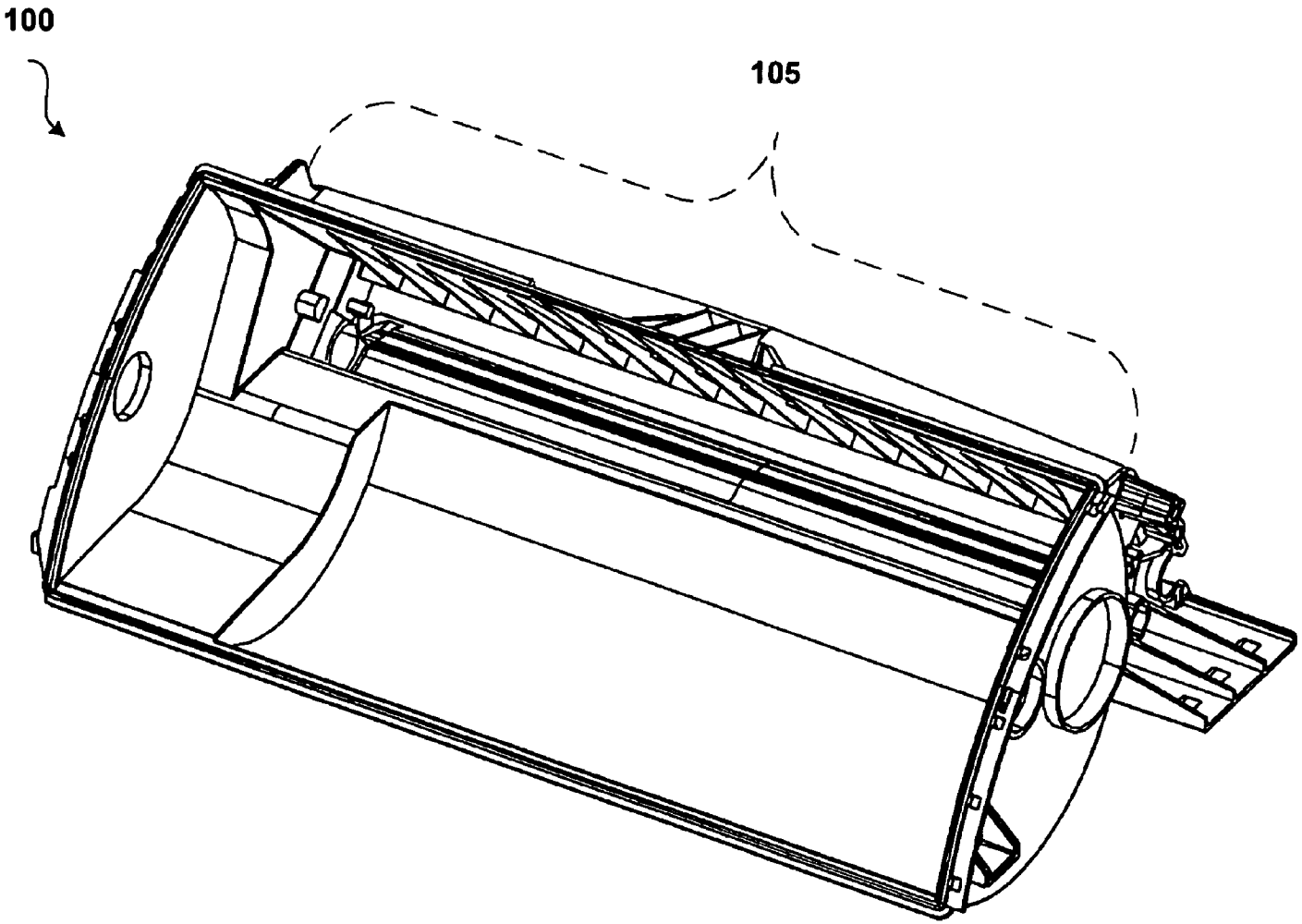
Fig. 1a (prior art)
FIG. 1*a* illustrates a rear cut-away view of an unsupported developer housing of a conventional toner cartridge (without the sump)
Figure 1B:
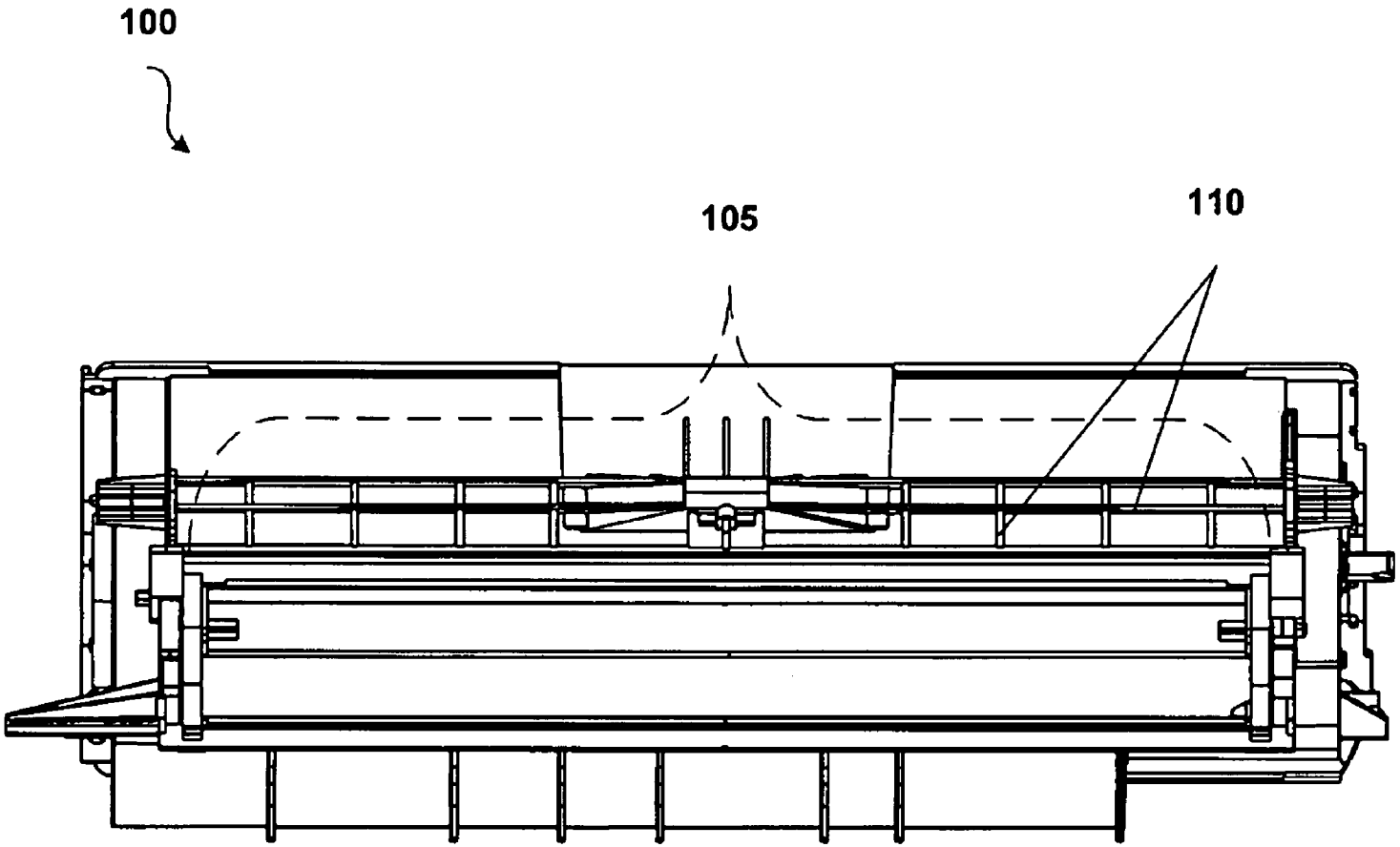
Fig. 1b (prior art)
FIG. 1*b* illustrates a front view of the unsupported developer housing of the conventional toner cartridge (without the sump) shown in FIG. 1*a;*

FIGS. 1*a* and 1*b* illustrate an unsupported developer housing of a conventional toner cartridge design 100. As can be seen, standard external strengthening features 110, e.g. ribs, are provided (in both the vertical and horizontal directions) to reinforce the central portion of the developer housing 105. However, these features do not provide sufficient reduction in cartridge 100 housing flexure. In this sense, the central portion of housing 105 is unsupported. To prevent the developer housing 105 of cartridge 100 from flexing, and in accordance with an embodiment of the present invention, a support rib can be added to the cartridge near the developer roll opening to prevent housing flexure.

Figure 2A:
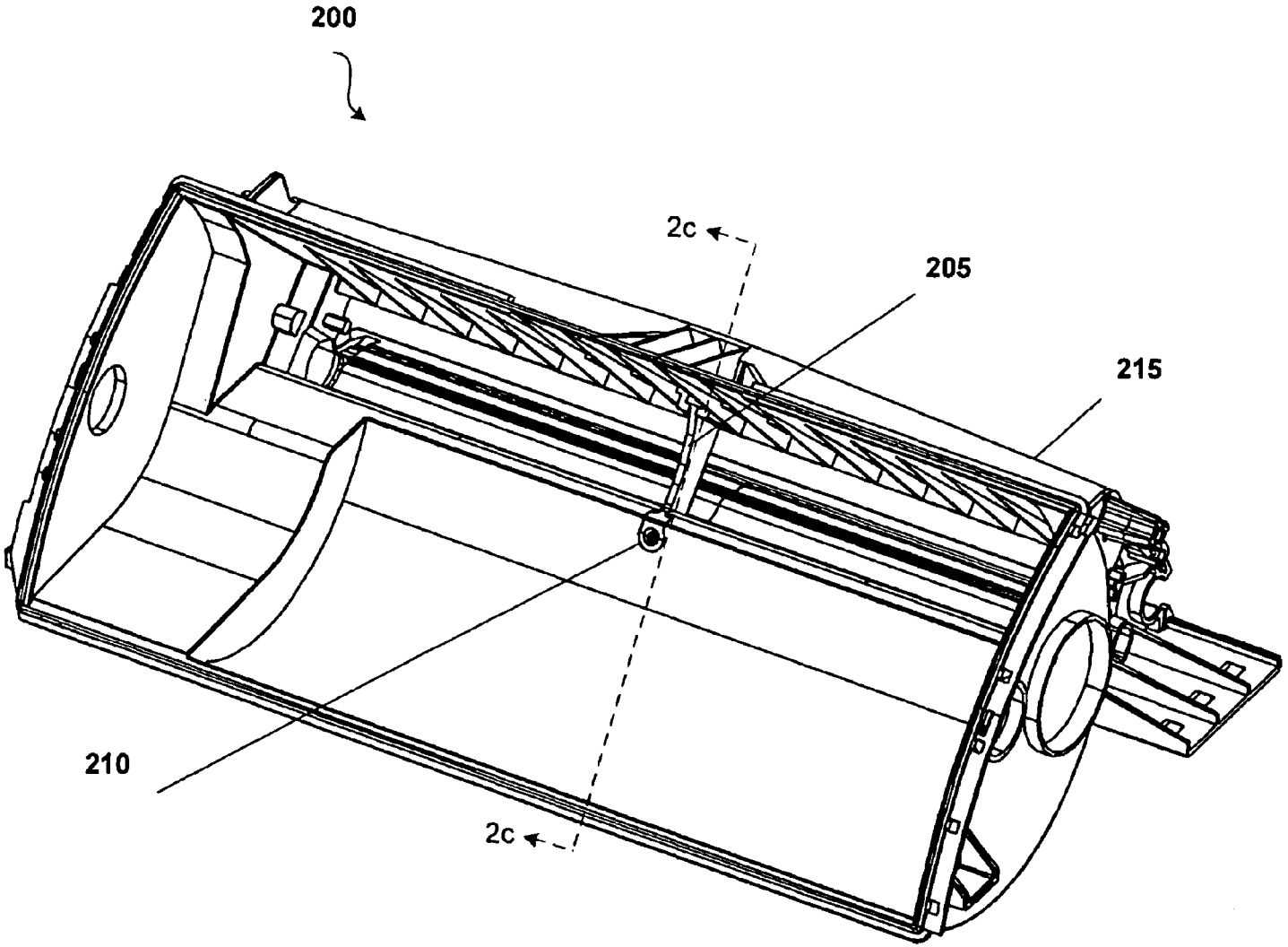
FIG. 2*a* illustrates a rear cut-away view of a toner cartridge (without the sump) configured with an internal support rib in the developer housing, in accordance with an embodiment of the present invention.
Figure 2B:
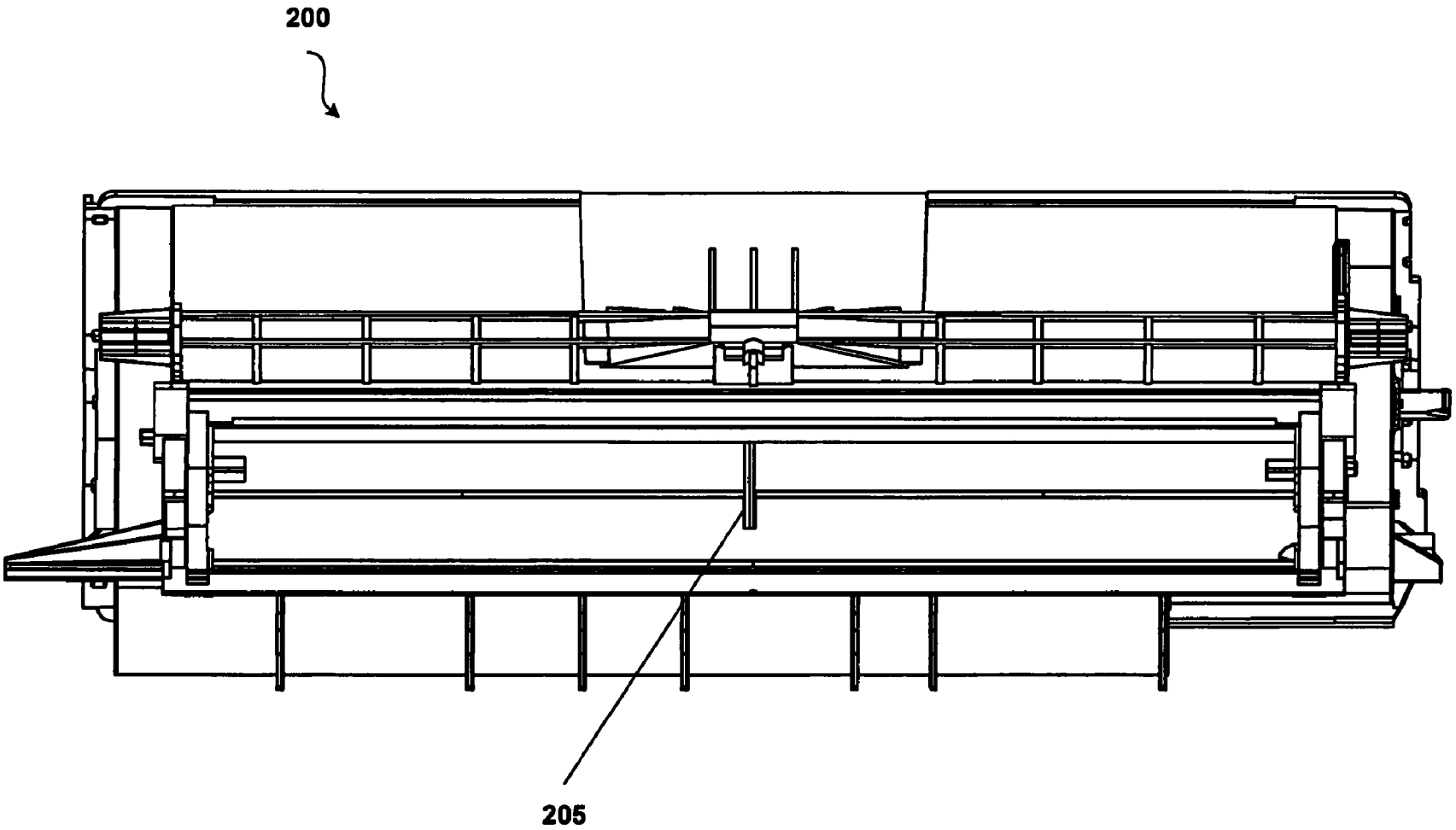
FIG. 2*b* illustrates a front view of the toner cartridge (without the sump) shown in FIG. 2*a;*

In more detail, and with reference to the example embodiment shown in FIGS. 2*a* and 2*b*, a support rib 205 is centrally located in the developer housing 215 of toner cartridge 200. As can be seen, the support rib 205 is secured to the housing 215 by an attachment mechanism 210, which in one embodiment is a screw. Numerous other fastening mechanisms, including both mechanical and chemical, can be used here as well such as a pressed fitting, rivet, nut-and-bolt combination, epoxy or rubber cement or other suitable bonding materials, or any other such fastening mechanism capable of securing the rib 205 to the housing 215. Alternatively, the support rib 205 can be formed as an integral part of developer housing 215 (e.g., using conventional injection-molding techniques). However, if it is desirable to avoid changes to an existing mold for forming housing 215, then a separate and distinct support rib 205 can be operatively coupled into the housing 215 using a fastening mechanism 210, as previously discussed and shown.

The support rib 205 is shown as being centrally located on the cartridge 200 near the developer roll opening to prevent housing flexure. In other embodiments, there may be two support ribs 205 deployed at positions offset from the center of the housing 215. In short, any number of support ribs 205 can be used as described herein. The number of support ribs deployed will depend on factors such as the size of the cartridge 200, the volume of toner within cartridge 200, and the length of the developer roll opening. In one example multiple support rib configuration, there is a support rib 205 every 2 to 6 inches in length of the developer roll opening. Thus, for a 6 to 10 inch developer roll opening, a single support rib 205 can be centrally located (e.g., in middle of developer roll opening), in accordance with one example embodiment. Likewise, for a 10 to 14 inch developer roll opening, a first support rib 205 located 4 inches from one end of the developer roll opening and a second support rib 205 located 4 inches from the other end of the developer roll opening, in accordance with another example embodiment. Numerous placement schemes can be used when deploying the support rib or ribs 205, whether the placement is symmetrical and/or more random in nature.

Figure 2C:
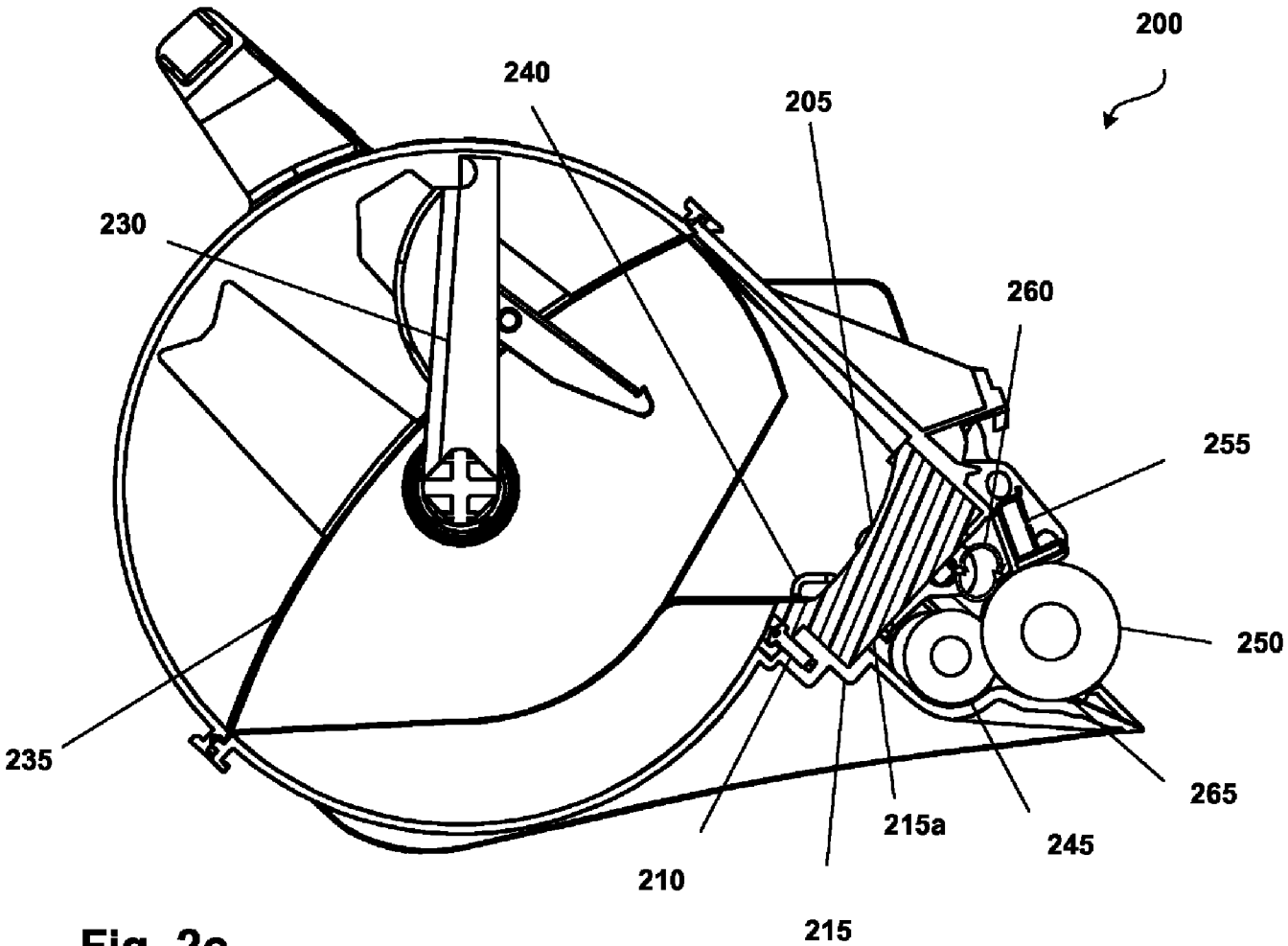
FIG. 2*c* illustrates a detailed cross-section view of the toner cartridge shown in FIG. 2*a*, with the sump present.

FIG. 2*c* illustrates a detailed cross-section view of the toner cartridge 200 shown in FIGS. 2*a* and 2*b*, but with the sump present. As can be seen, the toner cartridge 200 includes a number of conventional features, including a toner paddle 230, and upper toner sump 235, a lower toner sump 265, an agitator 240, a toner adder roll 245, a developer roll 250, and a doctor blade 255. Additional details of such features are provided, for example, in U.S. Pat. Nos. 6,181,904 and 7,248,806. In addition, the toner cartridge 200 includes a support rib 205 that is operatively coupled to the developer housing 215 and near the opening 215*a* via a screw or other suitable attachment mechanism 210. Recall that the opening 215*a* allows a controlled amount of toner to pass out of the housing 215 onto the toner adder roll 245 and developer roll 250.

Figure 3C:
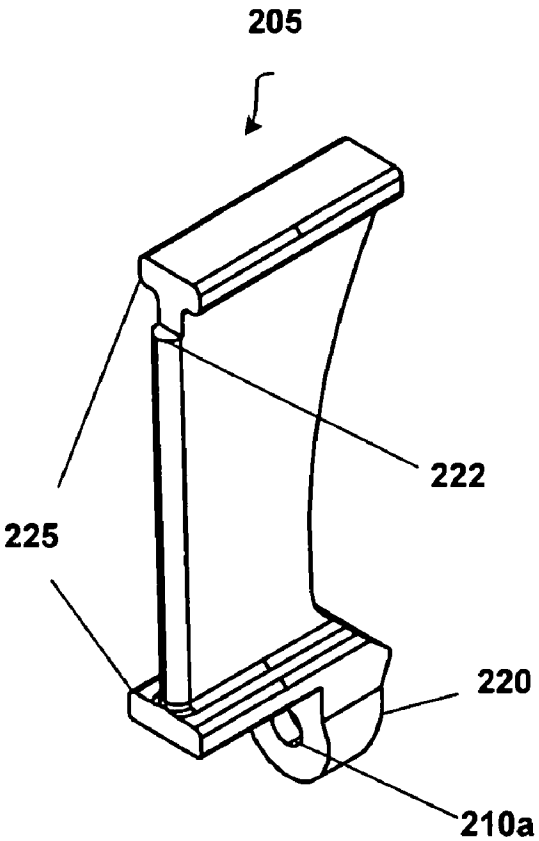
FIG. 3*c* shows a front isometric view of the support rib shown in FIG. 3*a;*
Figure 3B:
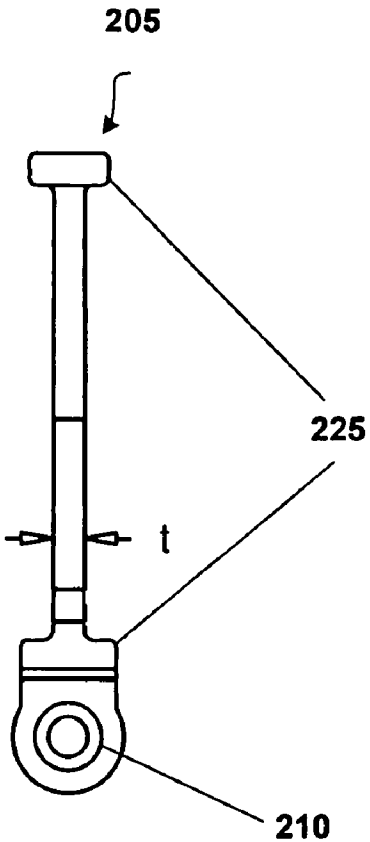
FIG. 3*b* illustrates a rear view of the support rib shown in FIG. 3*a;*

In one particular embodiment, the support rib 205 is made out of ABS plastic. ABS plastic provides suitable strength and resistance to breaking, which makes it an ideal material for the support rib 205. Other comparable plastic materials can be used as well. Alternatively, the support rib 205 can be made from metal, such as aluminum, steel, or any suitable metal alloy. In general, the support rib can be made from any material capable of providing sufficient strength and resistance to breaking in its given application and during a typical drop event where the toner cartridge is accidentally dropped to the floor or ground (gravity-based drop of about 1 to 5 feet). In one specific example embodiment, the support rib 205 is made from ABS plastic and has a thickness t (as best shown in FIG. 3*b*), wherein t is about 2 mm. In general, the thinner the thickness t of the support rib 205, the less the rib 205 impedes or otherwise restricts toner flow. An excessive restriction of toner flow tends to cause print defects on the printed page. Making the rib 205 as thin as possible eliminates or otherwise reduces restriction of toner flow. In general, the thickness t may vary depending on factors such as desired print quality and its impact on toner flow once the cartridge 200 is deployed.

Figure 3A:
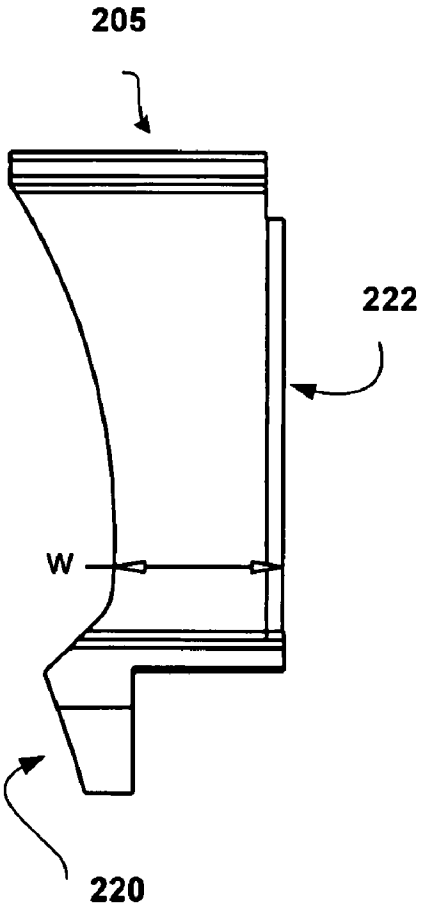
FIG. 3*a* illustrates a side view of a support rib configured in accordance with an embodiment of the present invention.

The curvature 220 indicated on the example embodiment shown in FIG. 3*a* matches the curvature of the upper sump 235, so that the toner paddle 230 does not bind up on the support rib 205 as it rotates to push toner towards the lower sump 265. The support rib 205 may have other shapes and profiles so as to facilitate its use without interfering with normal operation of the toner cartridge 200. Numerous such embodiments will be apparent in light of this disclosure. As previously mentioned, the rib 205 can be formed as an integral part of developer housing 215. Alternatively, and as demonstrated by the example embodiment shown in FIGS. 3*a*, 3*b* and 3*c*, an installable support rib 205 can be provided. In one such example embodiment, and as best shown in FIGS. 3*b* and 3*c*, the support rib 205 can be designed so that it is made as a separate part and then slid into the developer housing 215 using rails 225, and then secured in position with a screw or other suitable fastening mechanism 210 inserted through aperture 210*a*. This slide-in design accommodates an existing developer housing design. Other such customized support rib 205 designs will be apparent in light of this disclosure, and given an existing toner cartridge configuration. In addition, and with reference to the example embodiment shown in FIG. 3*c*, the front edge of the rib 205 is curved (curvature 222) or otherwise narrowed. This optional curvature or rounding 222 or narrowing can be provided in an effort to move a majority of the front edge of the support rib 205 away from the toner log 260 to further reduce the possibility of that front edge touching the toner log 260. Also, curvature 222 (or other suitable narrowing of front edge) can be provided so as to allow toner to flow around the support rib 205 and to join back together before the toner reaches the toner adder roll 245.

In accordance with one example embodiment, and as best seen with reference to FIG. 3*a*, the width w near the bottom of the rib 205 is about 10.8 mm, and gets wider towards the top. Such a rib design provides sufficient room for the agitator 240 to swing without being obstructed by the support rib 205, and further allows the agitator to be installed easily. In a more general sense, the support rib 205 may have any number of shapes that do not impede movement or installation of the agitator 240. In addition to accommodating movement and installation of agitator 240, this design (where the support rib 205 is wider near its top, relative to its bottom) also provides an amount of support material sufficient to prevent the rib 205 from breaking during typical large shock loads encountered during drop tests.

Figure 4A:
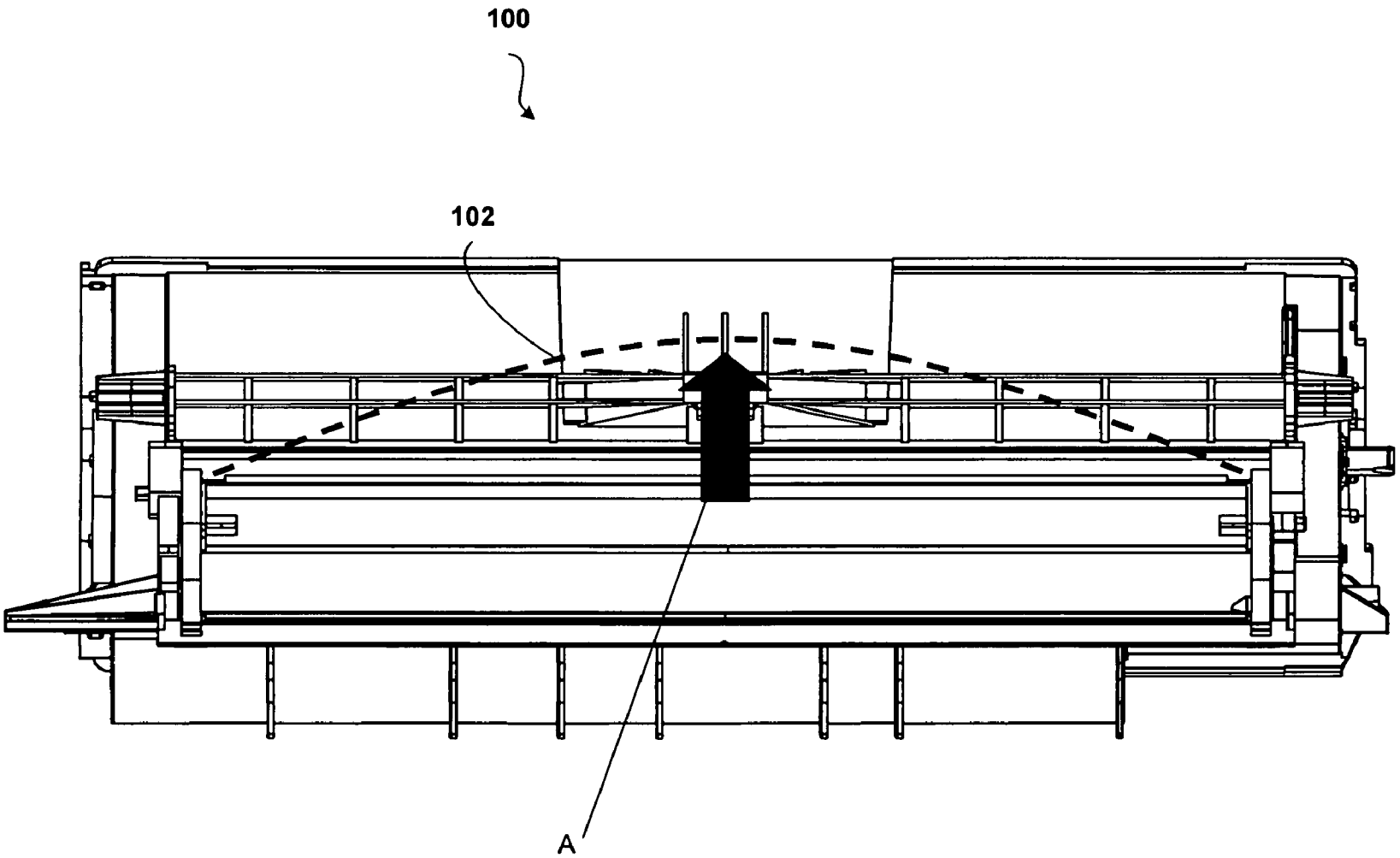
Fig. 4a (prior art)
FIG. 4*a* illustrates how an unsupported developer housing (without the sump) deflects upward (bowing) when a deflection force is applied.
Figure 4C:
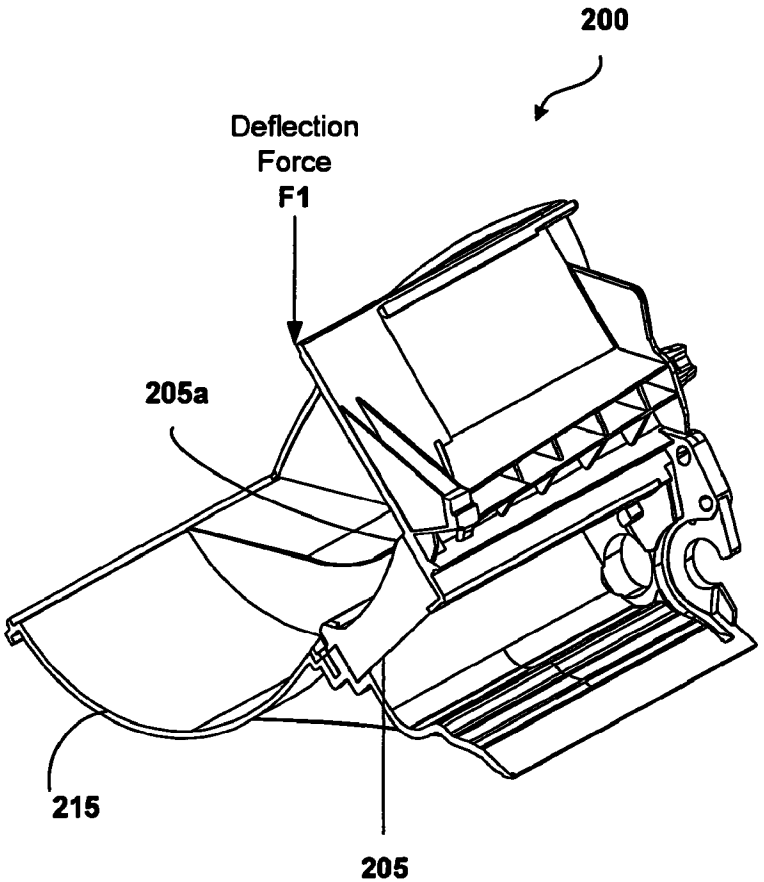
FIG. 4*c* illustrates a cross-section view of how an internal support rib configured in accordance with an embodiment of the present invention can be used to prevent deflection of developer housing (without the sump).
Figure 4B:
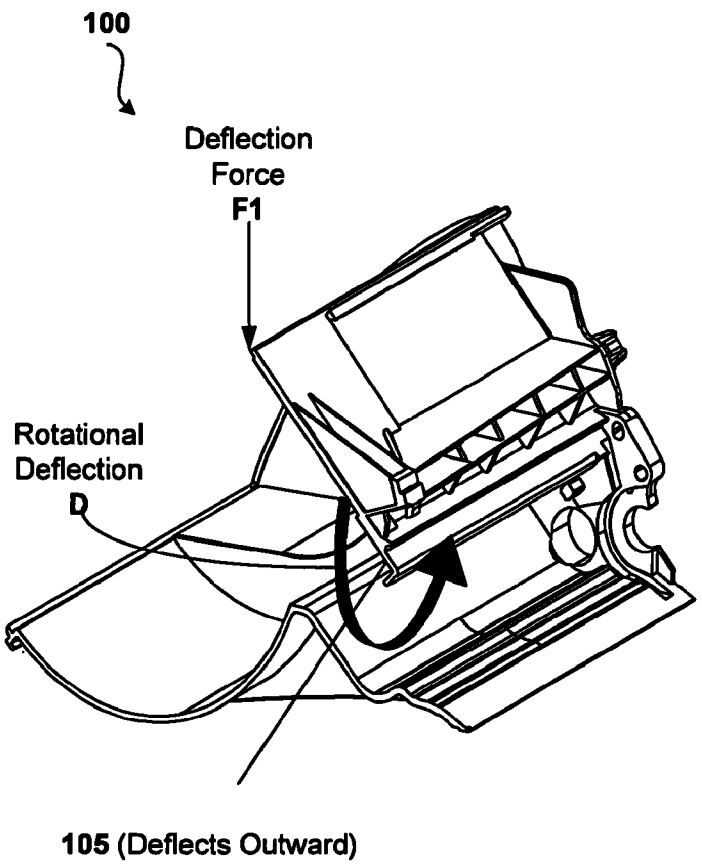
Fig. 4b (prior art)
FIG. 4*b* illustrates how an unsupported developer housing (without the sump) deflects outward (rotational deflection) when a deflection force is applied.

In addition, the design unexpectedly inhibits or otherwise prevents rotational deflection. In more detail, and with reference to FIGS. 4*a* and 4*b*, the housing can flex two different ways in response to an applied deflection force, as determined during various experimental drop tests. First, and as best shown in FIG. 4*a*, the housing can bow (dashed line 102) along the length of the opening of the developer housing 105 and deflects upward as indicated by arrow A. Second, and as best shown in FIG. 4*b*, the housing can exhibit rotational deflection D at the opening of the developer housing 105 when a deflection force F1 is applied. As shown in FIG. 4*c*, a support rib 205 can be used to eliminate or otherwise reduce such deflections. In this particular example embodiment, the wide portion 205*a* of the support rib 205 assists in preventing rotational deflection D. By preventing this outward rotational deflection D, a more robust seal is formed behind the doctor blade 255 to prevent toner leaks. Experimental drop tests were used to determine that the area behind the doctor blade 255 was a location of a major failure, leading to excessive toner leakage behind the doctor blade. This failure was directly related to excessive flexure of the housing 105. With the addition of the support rib 205, flexure of housing 215 was eliminated and, consequently, toner leaks were reduced during drop tests.

Figure 2D:
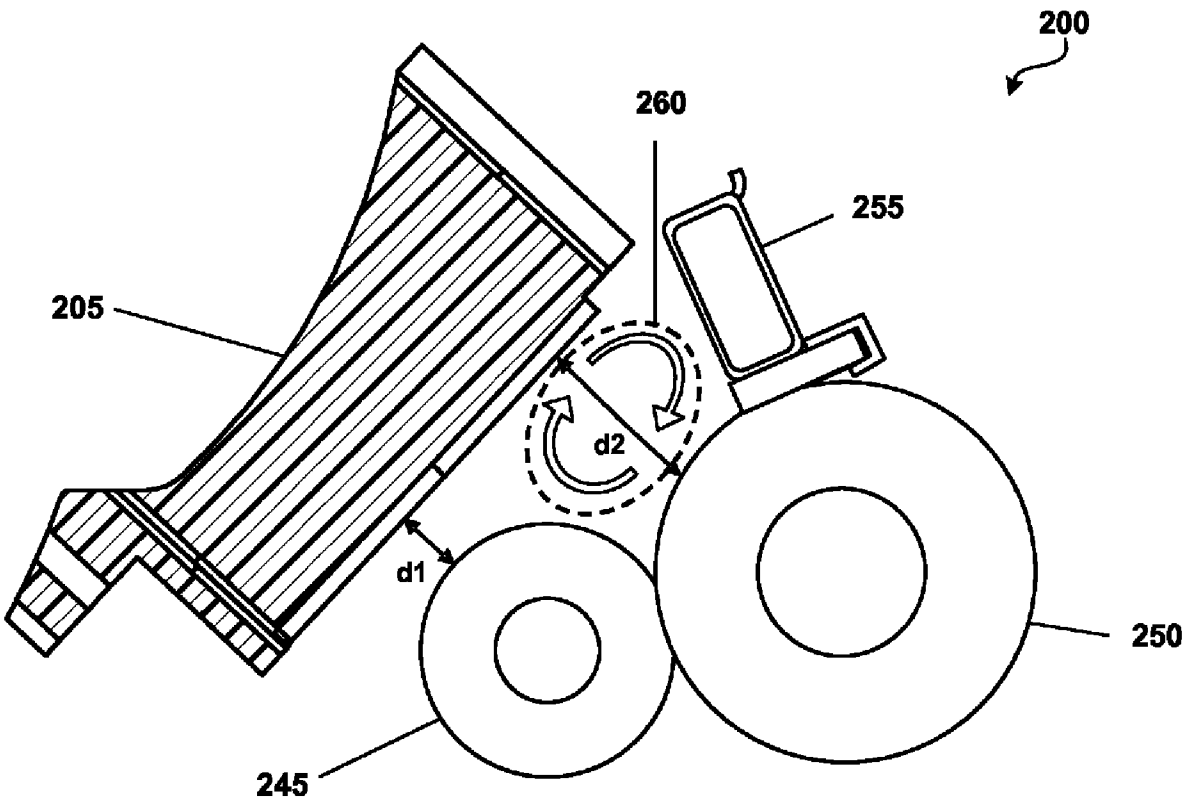
FIG. 2*d* illustrates a cross-section view of the toner cartridge shown in FIG. 2*c*, with a particular focus on the location of the toner log with respect to the internal support rib.

While the support rib 205 operates to decrease flexure of developer housing 215, it is also configured to not interfere with toner flow. In particular, restriction of toner flow may cause print defects. In order to prevent this, the support rib 205 can be designed with a thin profile (thickness t), so that it will not block toner moving from the upper toner sump 235 to the lower toner sump 265. Also, the support rib 205 profile can be designed so that it does not contact the toner log 260 located above the toner adder roll 245, and as best shown in FIGS. 2*c* and 2*d*. The toner log 260 refers to the toner recirculating inside the toner cartridge 200 above the toner adder roll 245 and developer roll 250. In general, it has been determined that interfering with the toner log 260 can produce print defects. Functional testing has shown that the addition of a properly configured support rib 205 does not affect the print quality.

In one specific embodiment, and with reference to FIG. 2*d*, the support rib 205 is positioned within the developer housing 215, such that it has a distance of d1 from the toner adder roll 245, and a distance d2 from the developer roll 250, wherein d1 equals 3.7 mm and d2 equals 9.3 mm. Other embodiments may have different distances for d1 and d2, ranging from 2 mm to 5 mm for d1 and from 5 mm to 15 mm for d2. In a more general sense, the distance d1 can be set so that toner passes between the support rib 205 and toner adder roll 245 and developer roll 250 in a substantially unobstructed fashion. In other words, the toner as it splits to flow around the support rib 205 has sufficient space afterward in which to recombine. Likewise, the distance d2 can be set so the support rib 205 does not touch the toner log 260, or so that undesired print quality defects are avoided. The distances d1 and d2 may further vary depending on factors such as desired print quality, size of the toner log 260, and the respective sizes of the toner adder roll 245 and the developer roll 250.

A support rib 205 as described herein provides a number of advantages to a toner cartridge, such as increased housing stiffness near the developer roll 250, improved sealing between the doctor blade seal and doctor blade 255, reduced toner leaks between the doctor blade 255 and developer roll 250, and increased overall robustness of the cartridge housing 215 seal interfaces when subject to high loads. In a general sense, the support rib 205 can be used to effectively reduce the beam length (e.g., unsupported cartridge housing) by half, or more, depending on the number of support ribs 205 deployed. For example, in the example embodiments shown in FIGS. 2*a* and 2*b*, the addition of the support rib 205 to the central portion of the beam effectively divides the long beam into two smaller beams, each with much less flexure.

Through the addition of a support rib 205, cartridge failures due to housing flexure caused by shock load (e.g., during shipping or customer handling) can be eliminated or otherwise reduced. In addition, toner leakage can be significantly reduced or eliminated, thereby yielding a better quality product having a longer life.

The foregoing description of various embodiments of the present invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A support rib for a toner cartridge, comprising:

two opposing and substantially flat sides defining a width w at a bottom portion and a wider top portion, and a thickness t, the sides configured to extend into a developer housing of the toner cartridge so as to not restrict toner flow;

and top and bottom edges at the top and bottom portions, respectively, each edge for operatively coupling to an internal wall within the developer housing and near an elongated opening of the developer housing that allows toner to pass onto a developer roll of the toner cartridge;

wherein the support rib inhibits flexure of the developer housing, to prevent toner leakage.

2. The support rib of claim 1 wherein the width w is about 10 mm to 11 mm and the thickness t is about 2 mm or less.

3. The support rib of claim 1 wherein the rib is integrally formed within the developer housing.

4. The support rib of claim 1 wherein the rib has a front edge that is rounded.

5. A toner cartridge, comprising:

a developer roll for providing toner during an imaging process;

a developer housing operatively coupled to the developer roll and for storing toner;

the developer housing configured with an elongated opening that allows a controlled amount of toner to pass onto the developer roll; and a support rib operatively coupled within the developer housing near the elongated opening, said rib inhibiting flexure of the developer housing, the support rib having a shape comprising:

two opposing and substantially flat sides defining a width w at a bottom portion and a wider top portion, and a thickness t, the sides extending into the developer housing so as to not restrict toner flow; and top and bottom edges at the top and bottom portions, respectively, each edge for operatively coupling to an internal wall within the developer housing and near the elongated opening.

6. The toner cartridge of claim 5 wherein the support rib is a distance d2 from the developer roll, such that the support rib does not interfere with a toner log recirculating inside the toner cartridge.

7. The toner cartridge of claim 6 further comprising a toner adder roll for delivering toner to the developer roll, wherein the support rib is a distance d1 from the toner adder roll, so that toner passes between the support rib and the toner adder roll in a substantially unobstructed fashion.

8. The toner cartridge of claim 7 wherein distance d1 is about 1 mm to 10 mm, and distance d2 is about 5 mm to 20 mm.

9. The toner cartridge of claim 7 wherein distance d1 is about 3 mm to 5 mm, and distance d2 is about 8 mm to 12 mm.

10. The toner cartridge of claim 7 wherein distance d1 is about 3 mm to 4 mm, and distance d2 is about 9 mm to 10 mm.

11. The toner cartridge of claim 7 wherein distance d1 is about 3.7 mm, and distance d2 is 9.3 mm.

12. The toner cartridge of claim 1 further comprising a doctor blade positioned to contact the developer roll and create a nip therebetween.

13. The toner cartridge of claim 1 wherein the support rib is made of, at least in part, ABS plastic.

14. The toner cartridge of claim 1 wherein the support rib is an integral component of the developer housing.

15. The toner cartridge of claim 1 wherein the support rib is secured to the developer housing a fastening mechanism.

16. The toner cartridge of claim 1 wherein the toner cartridge includes a plurality of spaced apart support ribs near the elongated opening of the developer housing and positioned along the length of the elongated opening.

17. The toner cartridge of claim 1 wherein a shape of the support rib prevents both bowing along the opening of the developer housing and rotational deflection of the developer housing.

18. The toner cartridge of claim 1 wherein width w is about 7 mm to 14 mm.

19. The toner cartridge of claim 1 wherein width w is about 10 mm to 11 mm.

20. The toner cartridge of claim 1 wherein width w is 10.8 mm.

* * * * *